US007605836B2

(12) United States Patent
Kuwabara

(10) Patent No.: US 7,605,836 B2
(45) Date of Patent: Oct. 20, 2009

(54) AUTO REGISTRATION IMAGE FORMING APPARATUS

(75) Inventor: Yoshihiro Kuwabara, Koshigaya (JP)

(73) Assignee: Ricoh Co., Ltd., Tokyo (JP)

( * ) Notice: Subject to any disclaimer, the term of this patent is extended or adjusted under 35 U.S.C. 154(b) by 319 days.

(21) Appl. No.: 11/668,183

(22) Filed: Jan. 29, 2007

(65) Prior Publication Data

US 2007/0177002 A1 Aug. 2, 2007

(30) Foreign Application Priority Data

Jan. 30, 2006 (JP) ..... 2006-021126

(51) Int. Cl.
*B41J 2/44* (2006.01)
*B41J 29/38* (2006.01)

(52) U.S. Cl. ..... 347/248; 347/234

(58) Field of Classification Search ..... 347/234, 347/248

See application file for complete search history.

(56) References Cited

FOREIGN PATENT DOCUMENTS

JP 05-002298 * 1/1993

JP 2001-96791 4/2001

OTHER PUBLICATIONS

Computer-generated translation of JP 05-002298, published on Jan. 1993.*

* cited by examiner

*Primary Examiner*—Huan H Tran
(74) *Attorney, Agent, or Firm*—Oblon, Spivak, McClelland, Maier & Neustadt, L.L.P.

(57) ABSTRACT

An image forming apparatus forms a latent image on a photoconductive member by scanning a light beam with a rotational deflector, and forms a visual image on a sheet without temporarily stopping the sheet on a sheet conveyance path. The image forming apparatus includes a motor that drives the rotation deflector when an image formation instruction is given, a rotation status-determining device that determines if the motor driven the rotation deflector reaches steady state, and a sheet feed control device that starts conveying the sheet (from a starting position of the sheet conveyance path) when the rotation status-determining device determines that the motor reaches the steady state. A detection device detects a passage time when the sheet passes a prescribed position on the sheet conveyance path. A latent image formation control device starts forming a latent image on the photoconductive member based on the passage time.

5 Claims, 7 Drawing Sheets

| DPI SIGNAL (CODE) | PIXEL DENSITY (dpi) | MOTOR ROTATION NUMBER (rpm) | TIME PERIOD UP TO STEADY STATE (sec) |
|---|---|---|---|
| 00 | 200 | 6000 | 2.0 |
| 01 | 240 | 7200 | 2.2 |
| 10 | 300 | 9000 | 2.5 |
| 11 | 400 | 12000 | 3.0 |

AUTO REGISTRATION IMAGE FORMING APPARATUS

CROSS REFERENCE TO RELATED APPLICATION

This application claims priority under 35 USC §119 to Japanese Patent Application No. 2006-021126 filed on Jan. 30, 2006, the entire contents of which are hereby incorporating by reference.

BACKGROUND OF THE INVENTION

1. Field of the Invention

The present invention relates to an electro-photographic image forming apparatus, such as a printer, a copier, etc., and in particular, to an image forming apparatus capable of synchronizing a sheet in a transfer process without temporary stopping the sheet during sheet conveyance.

2. Discussion of the Background Art

An optical scanning type image forming apparatus such as an electro-photographic image forming apparatus is widely used in a LBP (Laser Beam Printer), a facsimile, or the like, due to its high speed and high-resolution performances. Such an electro-photographic image forming apparatus generally includes a rotational photoconductive drum and various sections, such as a charger for charging the photosensitive surface of the photoconductive drum, an exposure section for exposing the photoconductive surface with charge and form a latent image, a developing section for supplying toner and making the latent image into a toner image, and a transfer section for transferring the toner image onto a sheet, around the photoconductive drum.

In the image forming apparatus, a polygon mirror constantly rotates and scans a laser beam emitted from a semiconductor laser to execute exposure on the surface of the photoconductive member in a main scanning direction. A polygon motor for driving the polygon mirror is conventionally in the standby state, and starts rotating as image formation starts. A sheet is conveyed and stopped at a prescribed position right before a transfer position. Then, sheet feeding is restarted by a registration clutch mechanism, for example, after a prescribed time has elapsed. That is, the sheet restarts for the purpose of waiting steady state rotation and synchronization with the image formation. However, since reach of the steady state rotation is not always detected conventionally, the prescribed time tends to be unnecessarily longer, sometime, thereby resulting in slow printing of the first sheet.

Then, Japanese Patent Application Laid Open No. 5-2298 attempts to employ a detection device for detecting if a polygon motor reaches steady state rotation and for restarting sheet feeding when the steady state rotation is detected in a registration clutch using image forming apparatus. Further, many low price machines do not generally include a registration clutch for the purpose of reducing cost.

In such a conventional image forming apparatus, the slow printing out can be avoided indeed, but is costly due to extra employment of the registration clutch. Further, the low price machine generally causes deviation of an image on a transfer sheet due to omission of synchronization between the image and the sheet at a transfer position.

SUMMARY OF THE INVENTION

Accordingly, an object of the present invention is to improve such background arts technologies and provides a new and novel auto registration image forming apparatus that forms a latent image on a photoconductive member by scanning a light beam with a rotational deflector, and forms a visual image on a sheet without temporarily stopping the sheet on a sheet conveyance path. Such a new and novel auto registration image forming apparatus includes a motor that drives the rotation deflector when an image formation instruction is given, a rotation status-determining device that determines if the motor driving the rotation deflector reaches steady state, and a sheet feed control device that starts conveying the sheet (from a starting position of the sheet conveyance path) when the rotation status-determining device determines that the motor reaches the steady state. A detection device detects a passage time when the sheet passes a prescribed position on the sheet conveyance path. A latent image formation control device starts forming a latent image on the photoconductive member based on the passage time.

In another embodiment, the rotation status-determining device determines that the motor has reached the steady state when receiving a steady state signal indicating that the motor is in a steady state condition.

In yet another embodiment, a sheet feed control device starts conveying the sheet at a prescribed time (from a starting position of the sheet conveyance path) so that the motor can reach the steady state (when the sheet reaches) a prescribed position on the sheet conveyance path, said sheet feed control device calculating the prescribed time based on a time needed for the motor rotated by the image formation instruction can reach the steady state.

In yet another embodiment, the prescribed time starts when motor rotation starts and is calculated based on a difference between a time period for the motor to credibly become a steady state condition and that needed for the sheet to arrive at the prescribed position from the sheet starting position.

In yet another embodiment, the latent image formation device starts forming the latent image when a prescribed time period has elapsed after the passage time is detected.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
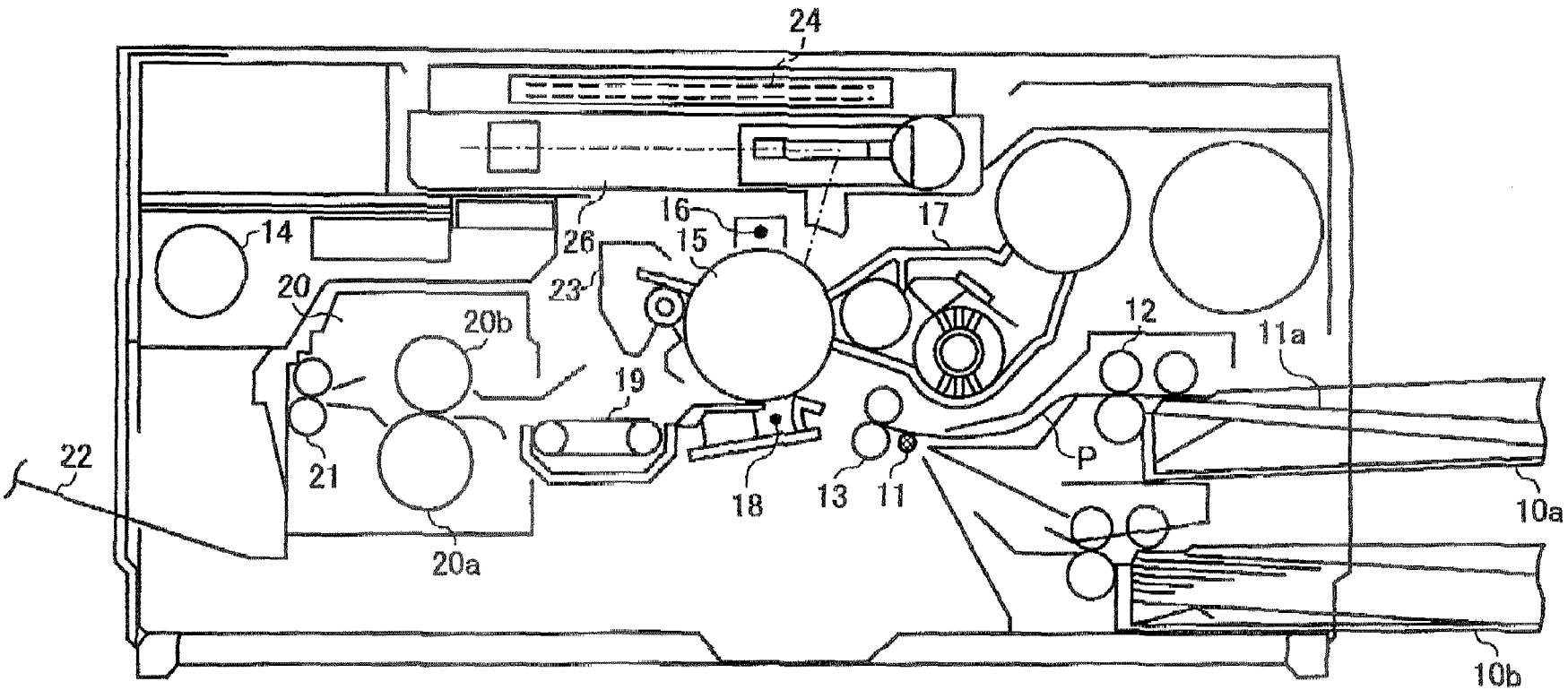
FIG. 1 schematically illustrates a mechanism of an exemplary laser printer according to one embodiment of the present invention.

Referring now to the drawing, wherein like reference numerals designate identical or corresponding parts throughout several views, in particular in FIG. 1, an exemplary interior mechanism of a laser printer (LBP) is described as one embodiment of the present invention.

In the laser printer, a sheet feed roller 12 feeds a sheet P from a sheet stack 11*a* lying on a sheet feed cassette 10*a* among one of up and down two step sheet feeding cassettes 10*a* and 10*b*. The sheet P is synchronized with latent image formation by a registration sensor 11 without stopping. Then, the sheet P is conveyed to a transfer position in the vicinity of a photoconductive drum 15 by a pair of registration rollers 13. A charger 16 charges the surface of the photoconductive drum 15 rotated by a main motor 14 in a direction as shown by an arrow. The surface is charged and is then scanned by a spot of the laser beam emitted and modulated from an optical write unit 26, thereby a latent image is formed on the surface of the photoconductive drum 15. The latent image is then supplied with toner by a developing unit 17 and is visualized.

The toner image is transferred by a transfer charger 18 onto the sheet P conveyed by the pair of registration rollers 13. The sheet P with the toner image is separated from the photoconductive drum 15 and is fed to a fixing unit 20 by a conveyance belt. Then, the sheet P is pressure contacted by a pressure roller 20*a* against a fixing roller 20*b*, and the toner image is fixed by pressure and heat previously increased. The sheet P out of the fixing unit 20 is then ejected by a sheet ejection roller 21 onto an ejection tray arranged on a side surface of the printer. The toner remaining on the photoconductive drum 15 is removed and collected by a cleaning unit 23. A print circuit board 24 mounting a controller and a control system for a printer engine or the like is arranged in an upper section of the printer.

Figure 2:
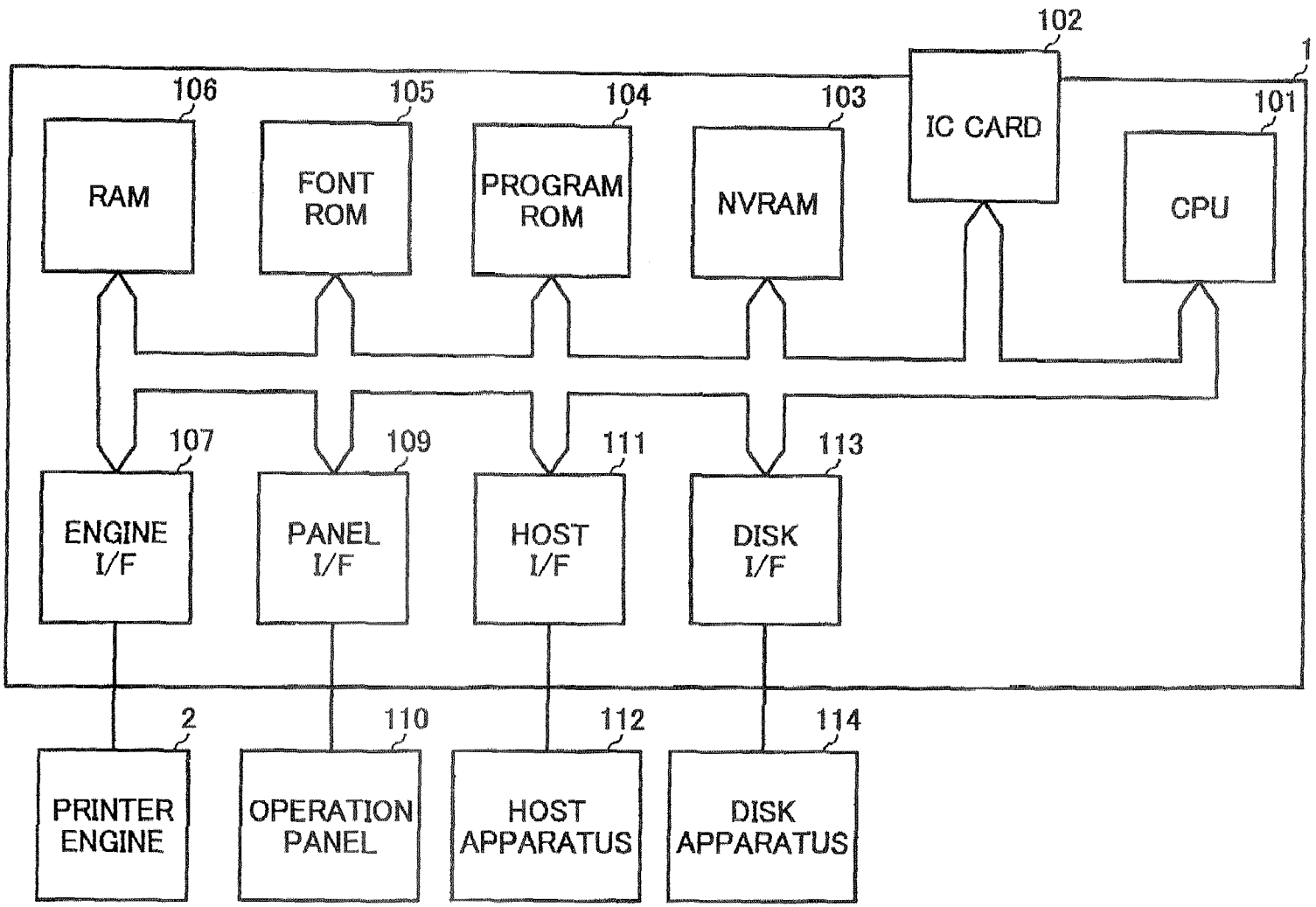
FIG. 2 is a block chart illustrating a configuration of an exemplary controller of the laser printer according to one embodiment of the present invention.

Now, an exemplary configuration of a controller 1 is described with reference to FIG. 2. As shown, the controller 1 includes a CPU 101, an IC card 102 for externally provided font data or program, a NVRAM 103 as a non-volatile memory for storing mode indication contents transmitted from an operation panel 110 or the like, a program use ROM 104, a font use ROM 105 for storing pattern data of the font, a RAM 106, an engine interface 107 for communicating commands, statuses, and printing data or the like with a printer engine 2, a panel interface 109 for communicating commands and statuses or the like with the operational panel 110, a host interface 111, and a disc interface 113 for communicating commands, statuses, and data or the like with a disc apparatus 114.

The CPU 101 generally controls the controller by means of program stored in the program use ROM 104, mode instruction from the operation panel 110, and commands from a host apparatus 112 or the like. The RAM 106 is used as a work memory for the CPU 101, a buffer memory for storing input data, a page buffer for storing printing data, and a memory for download font use or the like. The operation panel 110 notifies a user of a current printer status and executes mode instruction and similar things. The host interface 111 includes a Centro interface or a RS232C, and communicates with the host apparatus 112. The disk apparatus 114 includes a floppy disc apparatus or a hard disk drive apparatus, and stores various data, such as font data, program, printing data, etc.

Now, an exemplary polygon motor control system arranged in a printer engine 2 is described with reference to FIG. 3. As shown, the printer engine 2 includes a ROM 3, a counter 4, and a PM rotation control section 6 serving as a motor control device having a PM (polygon motor) driver 5. Also included are a rotation deflector 8 having a polygon mirror, not shown, directly connected to and driven by a polygon motor 7 via a shaft 9, a sheet feeding clutch 27 for transmitting driving force conveyed from a main motor 14 to the sheet feeding roller 12, and a clutch driver 28 for receiving a signal from an engine CPU 31 and driving a sheet feed clutch 27 or the like.

Now, an exemplary table showing numerous values used in operation control is described. A DPI signal includes a two-bit code to be used by the engine CPU 31 of the engine interface 107 to indicate pixel density to the PM rotation control section 6, and represents pixel density (DPI). A number of rotations (rpm) of the polygon motor 7 corresponds to the pixel density. The CPU 31 outputs a DPI signal to the ROM 3 of the PM rotation control section 6 in accordance with pixel density indicated by the host apparatus 112 before printing starts. The ROM 3 receives an input of the DPI signal as an address, and outputs and sets a frequency-dividing ratio stored in a corresponding address into a counter 4.

The counter 4 counts a number of clocks (CLK) separately inputted thereto, and clears a counted value every when the counted value reaches a prescribed value of the frequency dividing ratio already set. The counter 4 simultaneously restarts counting and outputs a pulse signal to the PM driver 5. Thus, the PM driver 5 outputs a driving pulse in synchronous with the pulse signal to the polygon motor 7 in order to synchronously rotate the polygon motor 7. Accordingly, the polygon motor 7 rotates at a number of rotations corresponding to pixel density designated from among respective pixel densities as shown in FIG. 4. A laser beam modulated in accordance with image data is scanned by a rotation deflector 8 rotating at the number of rotations, thereby a prescribed latent image is formed on the photoconductive drum 15. Further, when a series of jobs, such as image reading for one or more pages, etc., is completed with designated pixel density, the laser printer enters a standby state.

Figures 3, 4:
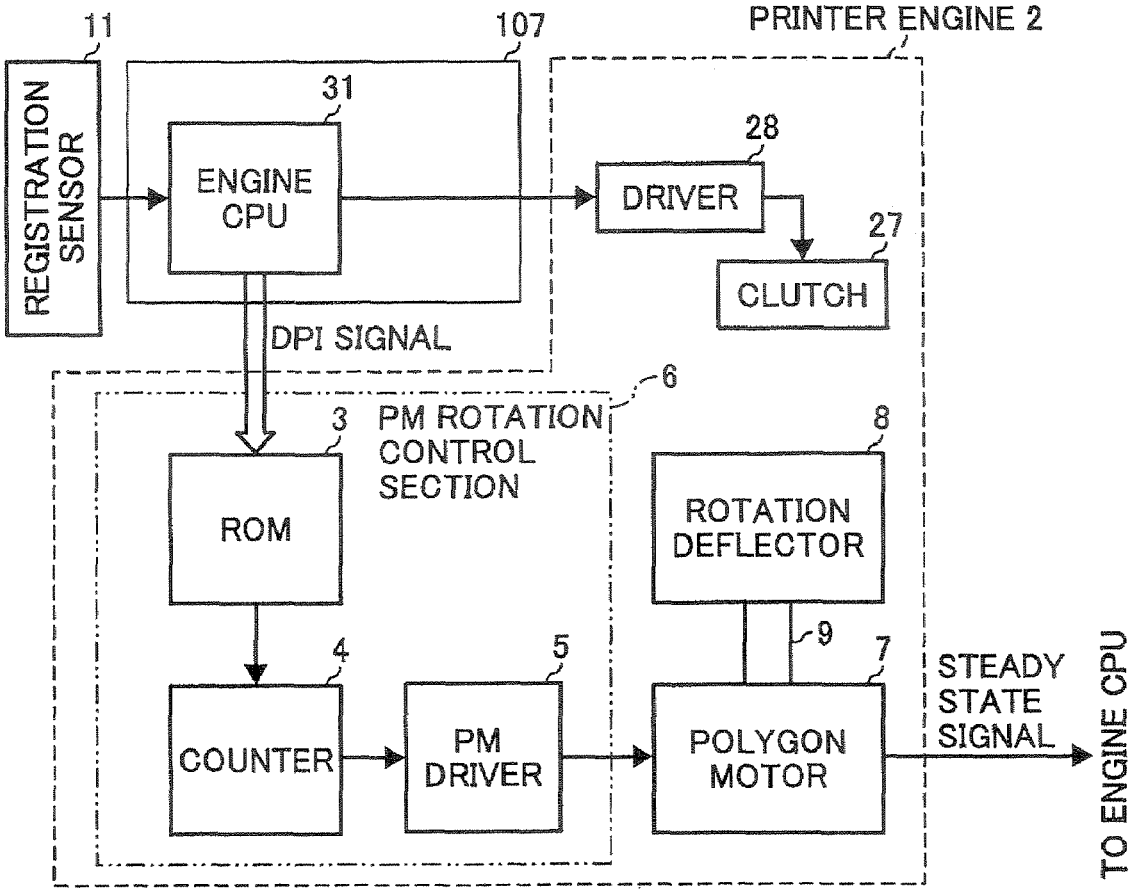
FIG. 3 is a block chart illustrating a configuration of an exemplary main section of a control system of the laser printer according to one embodiment of the present invention.
FIG. 4 illustrates exemplary numeric values used in controlling the laser printer according to one embodiment of the present invention.

FIG. 4 shows an exemplary relation between pixel density, a number of rotations of a motor, and a time period for the motor to become steady state is described on condition that the same conveyance speed is used regardless of the pixel density. As shown, as the pixel density increases, the number of rotations of the motor per minute needs to be increased. Thus, the time period for the motor to reach a steady state correspondingly increases.

Figure 5:
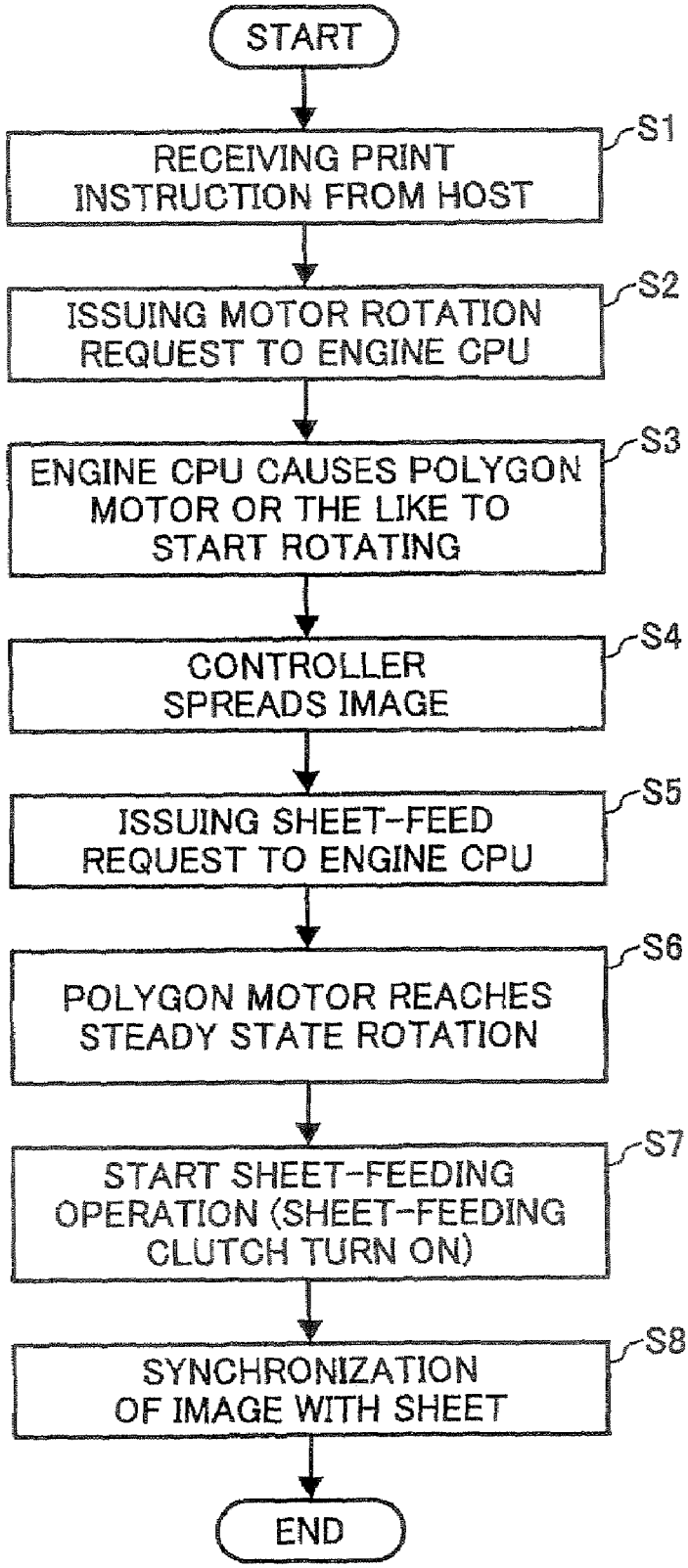
FIG. 5 is a flowchart illustrating an exemplary main section of the laser printer according to one embodiment of the present invention.

Now, several embodiments are described. As mentioned heretofore, the engine CPU 31 realizes a rotation condition-determining device, a sheet feed control device, and a latent image formation control device as claimed. The registration sensor 11 serves as a detection device as claimed Now, a sequence of an exemplary operation according to one embodiment of the present invention is described with reference to FIG. 5. Initially, the CPU 101 in the controller 1 receives a print instruction including pixel density from the host apparatus 112 in step S1. Then, the CPU 101 issues a motor rotation request including the pixel density to the engine CPU 31 in step S2. In response, the engine CPU 31 causes the main motor 14 and the polygon motor 7 to start rotation in step S3. To the polygon motor 7, the counter 4 outputs a pulse signal at a frequency in accordance with the pixel density in the above-mentioned manner. The controller 1 spreads printing data upon receiving from the host apparatus 112 into image data (e.g. bit map spreading) in step S4.

When spreading into the image data is completed, the CPU 101 issues a sheet-feeding request to the engine CPU 31 in step S5.

Then, the engine CPU 31 waits a steady state condition of rotation of the polygon motor 7, and determines that the rotation reaches the steady state condition when receiving a signal indicative of the steady state condition from the polygon motor 7 in step S6. The engine CPU 31 rotates the sheet feed roller 12 by turning on the sheet feed clutch 27, thereby sheet-feeding operation is started in step S7. The polygon motor 7 includes a stepping motor. A commercially available stepping motor generally includes a line indicating a steady state condition. In this embodiment, since determination if steady state rotation is reached is executed by using the steady state signal indicating line, detection of the steady state rotation can be not expensive. Further, the reason why the polygon motor 7 is monitored if it reaches the steady state rotation rather than the main motor 14 is that the polygon motor 7 employing the stepping motor takes longer time before arriving at the steady state rotation.

When a leading edge of the sheet passes through the pair of registration roller 13, the registration sensor 11 detects a passing time. The engine CPU 31 instructs the optical writing unit 26 to start exposing (writing onto) the surface of the photoconductive drum 15 when a time "e" has elapsed after the passing time in step S8. In this way, positioning of the sheet as to the image on the photoconductive drum can be credibly obtained. By starting exposure with the delay "e" after the passing time, i.e., not by immediately executing the exposure right after the detection, a position of the registration sensor 11 can be changed to freely adjust a write start position on a transfer sheet within a prescribed range.

Figure 6:
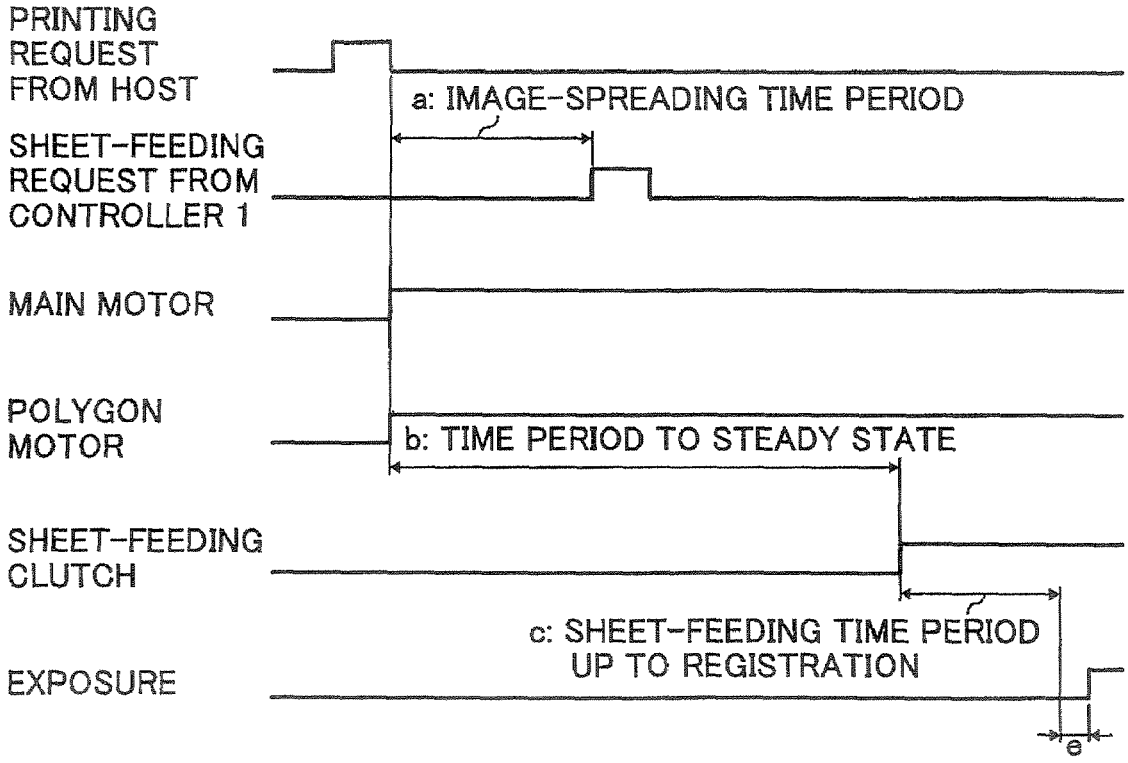
FIG. 6 is a time chart illustrating exemplary operation timing of the main section of the laser printer according to one embodiment of the present invention.

Now, an exemplary sequence when a first printing is executed is described with reference to FIG. 6. As shown, the sequence starts from print instruction reception to exposure (i.e., image writing onto a photoconductive drum). As shown, "a" represents a time period from when a print instruction is received from the host apparatus 112 to when the controller 1 completes spreading print image into image data. "b" represents a time period from when the polygon motor 7 starts rotating to when it reaches a steady state rotation (outputting of a steady state signal), "c" represents a time period during when a sheet arrives at a pair of registration rollers from a sheet feed start position, and "e" represents a difference between a time during when a sheet moves from the registration rollers to the transfer position and that during when the photoconductive member surface moves from the exposure position to the transfer position.

Thus, according to this embodiment, even the low price machine without a registration clutch can execute synchronization of a sheet with an image formed on a photoconductive member surface to be transferred. Further, since the synchronized sheet and the image advance at a constant speed, deviation does not occur there between. Further, since a main scanning (i.e., exposure scanning) is executed at a constant speed, an image does not twist.

Figure 7:
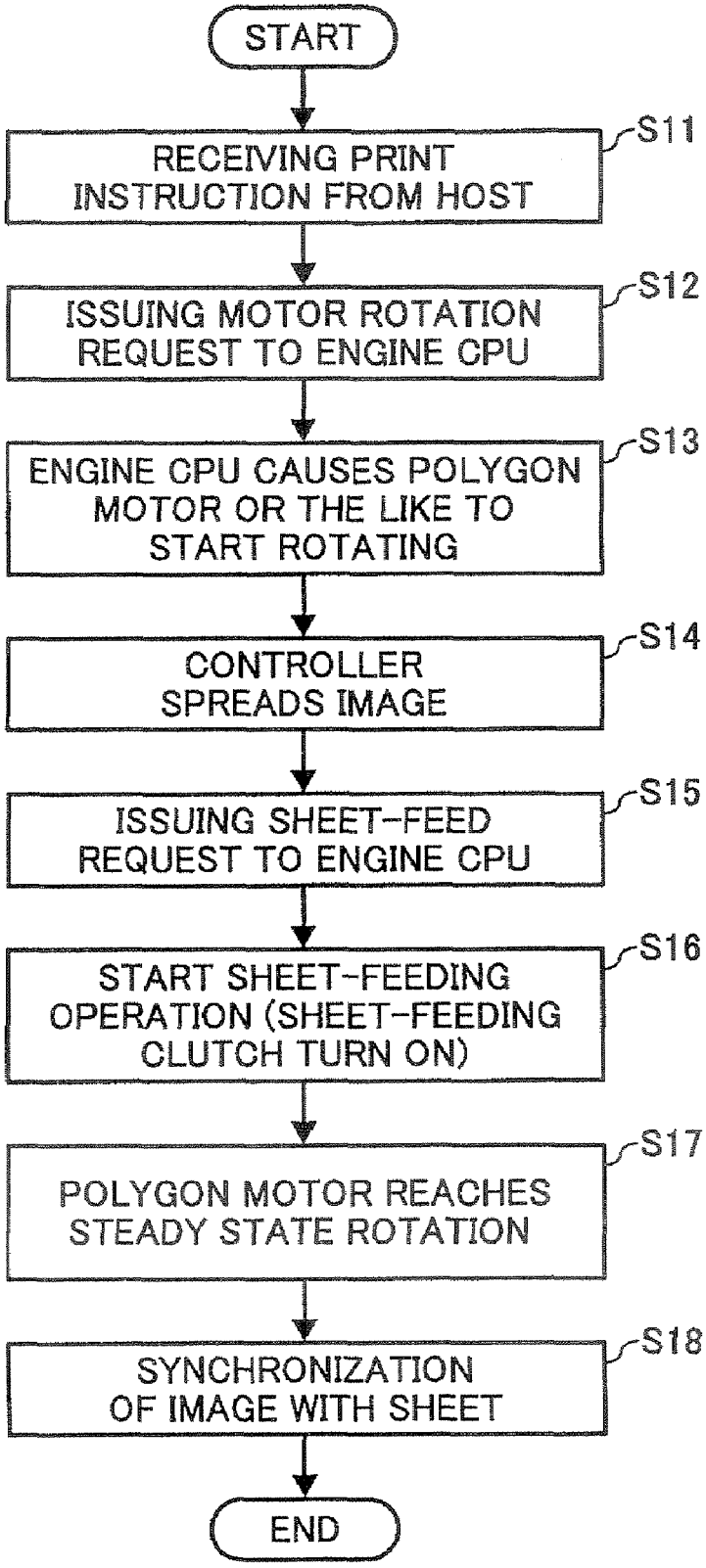
FIG. 7 is a flowchart illustrating an exemplary operation of the main section of the laser printer according to another embodiment of the present invention.

Now, an exemplary sequence of a second embodiment is described with reference to FIG. 7. Initially, the CPU 101 in the controller 1 receives a print instruction including the pixel density from the host apparatus 112 in step S11. Then, the CPU 31 issues a motor rotation request including the pixel density to the engine CPU 31 in step S12. The engine CPU 31 causes the main motor 14 and the polygon motor 7 to rotate in step S13. As mentioned above, the counter 4 outputs a pulse signal to the polygon motor 7 at a frequency in accordance with pixel density.

Figure 8:
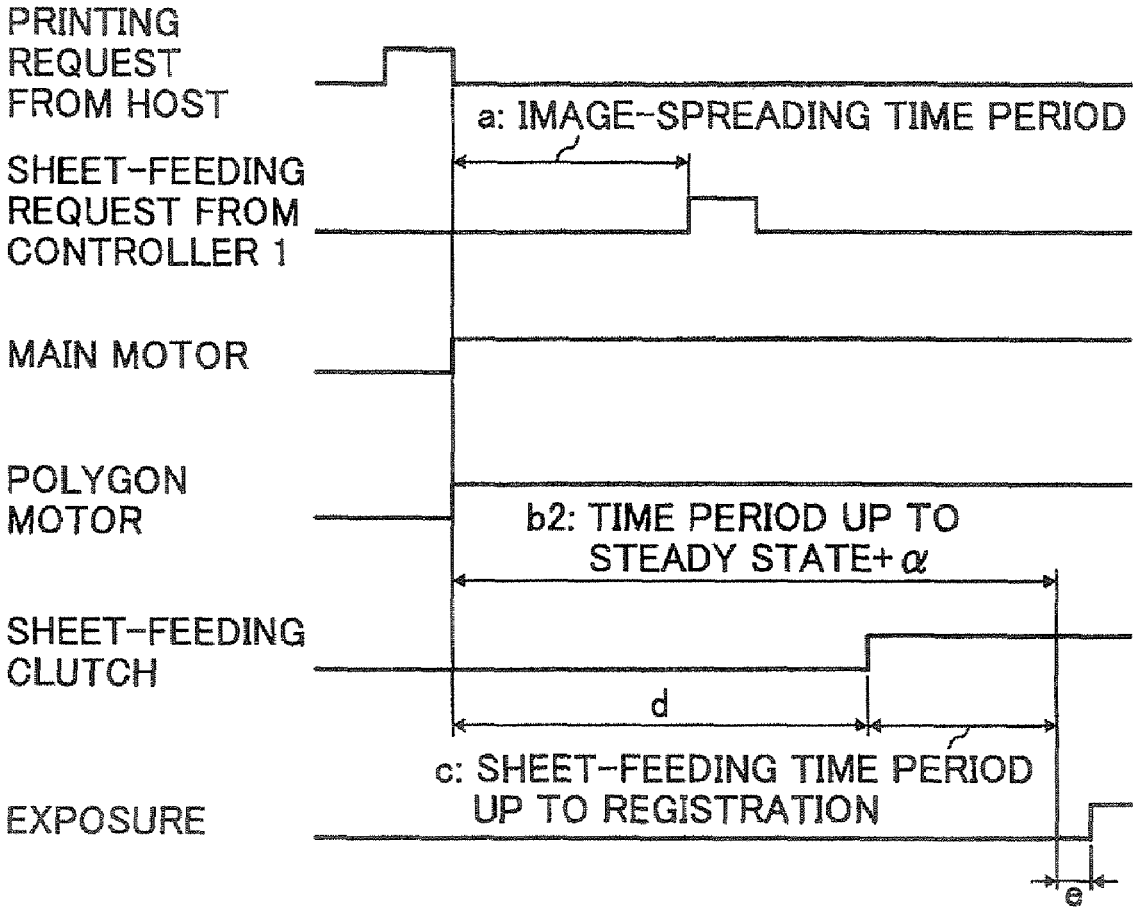
FIG. 8 is a time chart illustrating exemplary operation timing of the main section of the laser printer according to the other embodiment of the present invention.

The controller 1 at least spreads print data received from the host apparatus 112 into image data (e.g. bit map spreading) in step S14. When such spreading is completed, the CPU 101 in the controller 1 outputs a sheet-feeding request to the engine CPU 31 in step S15. When a time "d" (see FIG. 8) has elapsed after when the polygon motor 7 or the like starts rotating, the engine CPU 31 turns on the sheet feed clutch 27 and rotates the sheet feed roller 12. Thus, sheet feed operation is started in step S16. Such a time period "d" represents a difference between a time period b2 (see FIG. 8), calculated by adding a room alpha to a time period needed for the motor until steady state rotation while considering influence of unevenness and time deterioration of the polygon motor 7, and a time "c" (see FIG. 8) needed for a sheet to arrives at a pair of registration rollers 13 from a sheet feed starting position. Such a time period "d" is previously stored in a memory.

In this way, rotation of the polygon motor credibly reaches a steady state condition by the time when the leading edge of the sheet passes through the registration rollers 13 in step S17. Further, a passage time when the leading edge passes through the pair of registration rollers 13 is detected by the registration sensor 11, and the engine CPU 31 starts exposure on the surface of the photoconductive drum 15 carrying charge when the time period "e" has elapsed after the passage time in step S18. Thus, positioning between the sheet and the image on the photoconductive drum can be credibly achieved.

According to this embodiment, a sheet feeding is started when a time period "d", shorter than a time up to steady state, has elapsed after the polygon motor starts rotation, a first print time can be minimized more than that in the first embodiment maintaining the same advantage. Further, since the detection device for detecting if the polygon motor reaches a steady state rotation can be omitted, it is more cost effective.

Numerous additional modifications and variations of the present invention are possible in light of the above teachings. It is therefore to be understood that within the scope of the appended claims, the present invention may be practiced otherwise that as specifically described herein.

What is claimed is:

1. An image forming apparatus that forms a latent image on a photoconductive member by scanning a light beam with a rotational deflector, and forms a visual image on a sheet without temporarily stopping the sheet on a sheet conveyance path, said image forming apparatus comprising:

a motor configured to drive the rotation deflector when an image formation instruction is given;

a rotation status-determining device configured to determine if the motor driving the rotation deflector reaches steady state;

a sheet feed control device configured to start conveying the sheet (from a starting position of the sheet conveyance path) when the rotation status-determining device determines that the motor reaches the steady state;

a detection device configured to detect a passage time when the sheet passes a prescribed position on the sheet conveyance path; and a latent image formation control device configured to start forming a latent image on the photoconductive member based on the passage time.

2. The image forming apparatus as claimed in claim 1, wherein said rotation status determining device determines that the motor has reached the steady state when receiving a steady state signal indicating that the motor is in a steady state condition.

3. An image forming apparatus that forms a latent image on a photoconductive member by scanning a light beam with a rotational deflector, and forms a visual image on a sheet without temporarily stopping the sheet on a sheet conveyance path, said image forming apparatus comprising:

a motor configured to drive the rotation deflector when an image formation instruction is given;

a detection device configured to detect a passage time when the sheet passes a prescribed position on the sheet conveyance path;

a sheet feed control device configured to start conveying the sheet (from a starting position of the sheet conveyance path) when a prescribed time has elapsed after the rotation deflector starts rotating so that the motor can reach the steady state when the sheet reaches a prescribed position on the sheet conveyance path, said sheet feed control device calculating the prescribed time based on a time needed for the motor rotated by the image formation instruction can reach the steady state; and a latent image formation control device configured to start forming a latent image on a photoconductive member in accordance with the passage time.

4. The image forming apparatus as claimed in claim 3, wherein said prescribed time starts when motor rotation starts and is calculated based on a difference between a time period for the motor to credibly become a steady state condition and that needed for the sheet to arrive at the prescribed position from the sheet starting position.

5. The image forming apparatus as claimed in any one of claims 1 to 3, wherein said latent image formation control device starts forming the latent image when a prescribed time period has elapsed after the passage time is detected.

* * * * *